US005653127A

United States Patent [19]

Berger et al.

[11] Patent Number: 5,653,127

[45] Date of Patent: Aug. 5, 1997

[54] DEVICE ON A WARP KNITTING MACHINE FOR CROCHETING AN ELASTIC BAND WITH FLEECE AND AN ELASTIC BAND PRODUCED BY THIS DEVICE

[75] Inventors: Johann Berger, Alfdorf; Fritz Schulein, Treuchtlingen, both of Germany

[73] Assignee: Berger GmbH, Germany

[21] Appl. No.: 424,485

[22] PCT Filed: Oct. 19, 1993

[86] PCT No.: PCT/EP93/02890

§ 371 Date: Jul. 7, 1995

§ 102(e) Date: Jul. 7, 1995

[87] PCT Pub. No.: WO94/11554

PCT Pub. Date: May 26, 1994

[30] Foreign Application Priority Data

Nov. 12, 1992 [DE] Germany ..... 42 38 250.5

[51] Int. Cl.[6] ..... D04B 25/08

[52] U.S. Cl. ..... 66/85 R; 66/203

[58] Field of Search ..... 66/84 R, 85 R, 66/82 R, 203, 207, 214

[56] References Cited

U.S. PATENT DOCUMENTS

| | | | |
|---|---|---|---|
| 4,266,411 | 5/1981 | Linder et al. | 66/84 R |
| 4,389,860 | 6/1983 | Schneider | 66/84 R |
| 4,581,905 | 4/1986 | Bonaschi | 66/203 |
| 4,708,003 | 11/1987 | Berger et al. | 66/203 X |
| 4,745,781 | 5/1988 | Schuelein et al. | 66/214 |
| 5,452,591 | 9/1995 | King | 66/85 R X |

FOREIGN PATENT DOCUMENTS

| | | |
|---|---|---|
| 0 210 580 | 2/1987 | European Pat. Off. . |
| 0 266 481 | 5/1988 | European Pat. Off. . |
| 0 511 455 | 11/1992 | European Pat. Off. . |
| 33 04 326 | 8/1984 | Germany . |
| 41 31 809 | 3/1993 | Germany . |
| 2 012 828 | 8/1979 | United Kingdom . |

*Primary Examiner*—John J. Calvert
*Attorney, Agent, or Firm*—Banner & Witcoff, Ltd.

[57] ABSTRACT

A device on a warp knitting machine for crocheting an elastic band with a coating and an elastic band made with this device. The band may also have picots at its edges, that is small loops. The device is intended to facilitate the production of very fine bands with a distribution of more than eight and especially twelve needles per centimeter of machine width and even more if possible. The coating should be patternable. The coating may be produced on only one or on both sides of the strip. The device has crochet hooks (4), a cuttler (80) to feed skeins of rubber-elastic threads (14) and a cuttler (20) to feed skeins of warp threads (22).

8 Claims, 6 Drawing Sheets

DEVICE ON A WARP KNITTING MACHINE FOR CROCHETING AN ELASTIC BAND WITH FLEECE AND AN ELASTIC BAND PRODUCED BY THIS DEVICE

The invention relates in a first aspect to a device on a warp knitting machine (crocheting machine) for crocheting a textile band. The device having crochet needles, a laying device, a front single welt laying device, and a rear single welt laying device. This device can produce a particularly fine rubber band having fleece on at least one broadside. Bands of this kind are intended to be suitable for ladies' underwear, especially for bras and have a very soft surface, namely a fleece, on at least one of their broadsides.

The device is intended to permit the production of very fine bands with a distribution of more than eight and especially twelve or more needles per centimeter of machine width. The fleece should be patternable to a variable extent, with the possibility of producing a patterned fleece on only one side or on both sides of the band.

Such elastic bands may also be produced by weaving. However, if produced by weaving the rubber threads running in the longitudinal direction of the band are thread-covered prior to the actual weaving procedure, thus involving additional production costs.

The present invention eliminates this additional thread covering operation and the rubber threads are to be mesh-covered in the course of the crocheting procedure. In this way the production costs as compared to those of weaving can be reduced by roughly 30%.

From the publications EP-A-0210 518 and GB-A-2 012 828, a device according to the preamble of claim 1 is known which serves to produce a pile loop knitted fabric, i.e. a knitted fabric having highly protruding loops, such as e.g. in bath towels. With devices of this kind it is not possible to achieve the designed high finess of the band, namely more than eight, particularly more than twelve crocheting members per centimeter of machine width, since pile loop holders and sinkers need to be introduced between the crochet needles, which have such widths, however, that it is no longer possible to arrange the crocheting needles alongside each other in the required density. Also the eye needles for feeding the weft threads have correspondingly large spacings with respect to each other.

The above stated requirements are satisfied in common by the invention according to its claim 1 (the following employing the terms also defined in the claims).

Expressions such as "front", "rear", "right", "left" relate to the usual viewing location of an observer standing in front of such a crocheting machine (B in FIGS. 1 to 3, 5 and 6).

From an older German patent application P 41 31 809.9, but not of prior disclosure, by the same applicant it is evident how crochet needles are clamped in a needle bar with which they are moved backwards and forward, how arrays of warp threads are supplied from the front by sets of eye needles, arrays of elastic threads are moved from above through combs and a front and a rear single weft thread is moved to the right-left-right by means of a separate tube for each crosswise to an array of elastic threads.

The high fineness of the band is achievable by the aforementioned and further crocheting members being arranged in the desired fineness, i.e. involving more than eight, but especially twelve or more crocheting members per centimeter of machine width, up to 16 crocheting members per centimeter being the target. How eye needles are arranged in the required number per centimeter of machine width is shown by EP-A-0 266 481-BERGER.

To form a fleece on the forward broadside of the band (as viewed from the point of observation B) the invention positions a weft array laying device in front of the web for the arrays of rubber threads. A single weft laying device; i.e. a device lays a single weft thread or however a bundle of parallel weft threads crosswise over the width of the array elastic threads, is provided in front of and behind the web of elastic thread array. The weft array laying device is movable backwards and forwards as well as being arranged to permit side shifting, so that depending on which of the weft needles guides a set of weft threads, a desired fleece pattern can be achieved.

One other aspect of the invention relates to a rubber band crocheted on one of the claimed devices, have a high fineness and featuring a fleece on at least one of its broadsides.

Embodiments of both parts of the invention are defined by the subclaims.

If the band is also required to have a fleece on its rearside, a rear weft array laying device may be provided instead of a rear single weft laying device. Whereas if the band is required to be smooth on its rearside, i.e. without a fleece, only a single weft laying device is provided by known means which guides one or more weft threads over the full width of the band.

With respect to the desired high fineness of the elastic band the eye needles of the weft array laying device(s) are unable to engage between the heads of the crochet needles. The heads of the front weft array laying device engage at times from the front and from above between the warp thread eye needles of the warp thread array running from the warp thread guide needles to the mesh forming spot. The arrays of the front weft threads are then taken along by the warp threads to the heads of the crochet needles.

If a rear weft array laying device is employed, the heads of its eye needles are guided from the rear and above as near as possible to the mesh forming spot, namely to a position on the upper edges of a knock-over bar and a hold-back bar, between which the finish-crocheted elastic band is removed downwards, this applying in the retracted position of the crochet needles. The rear weft threads are engaged and taken along by the heads of the crochet needles.

The elastic band may have on one or both of its edges looplets (picots), which are produced by known means.

Example embodiments having further features of the invention will now be described with reference to the drawings in which.

Figure 1:
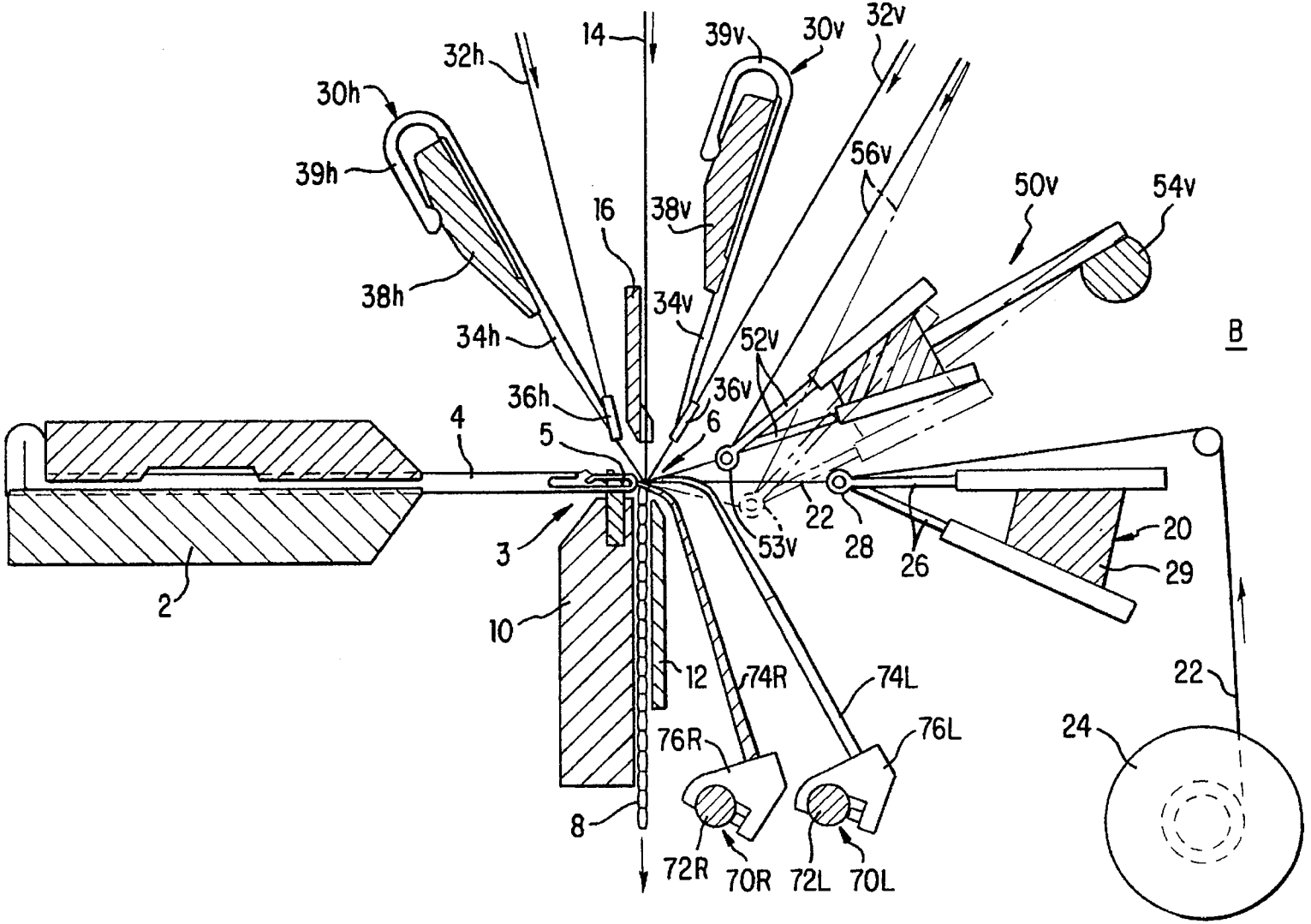
FIG. 1 is a left-hand side view of a crocheting machine having crocheting tools for producing an elastic band having a front fleece and picots on the edges.
Figure 2:
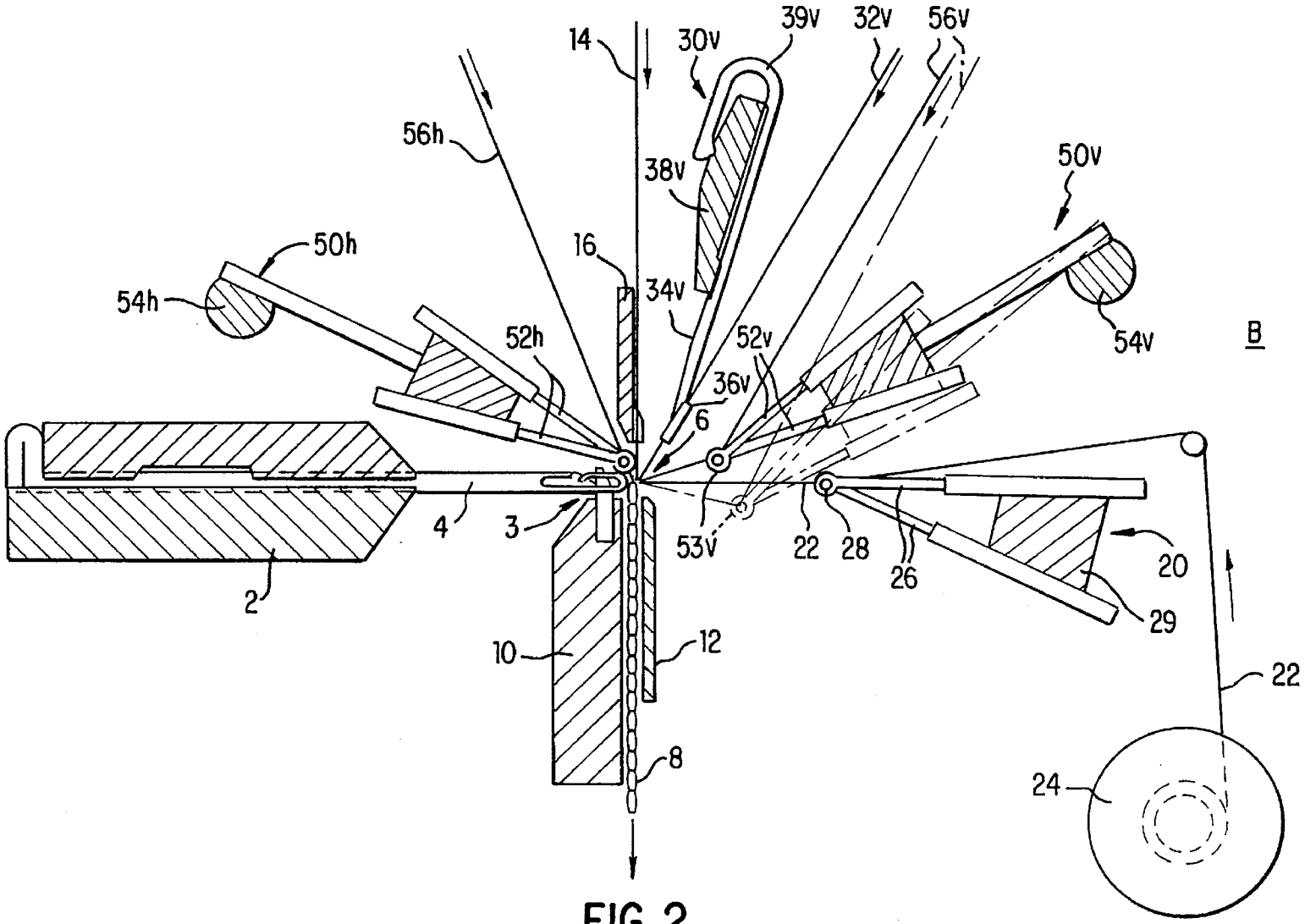
FIG. 2 illustrates in the same view the crocheting tools for producing an elastic band having a fleece on both sides, a device for producing picots being omitted to simplify the illustration.
Figure 3:
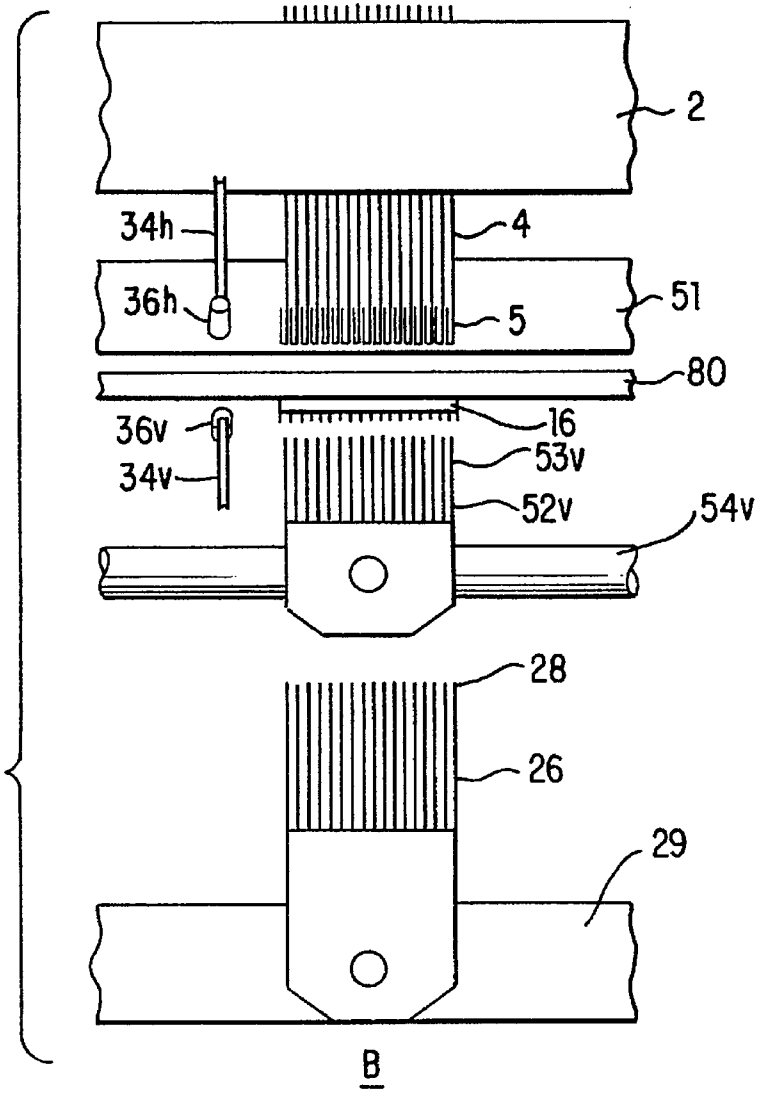
FIG. 3 is a plan view on some of the crocheting tools as shown in FIG. 1.
Figure 5:
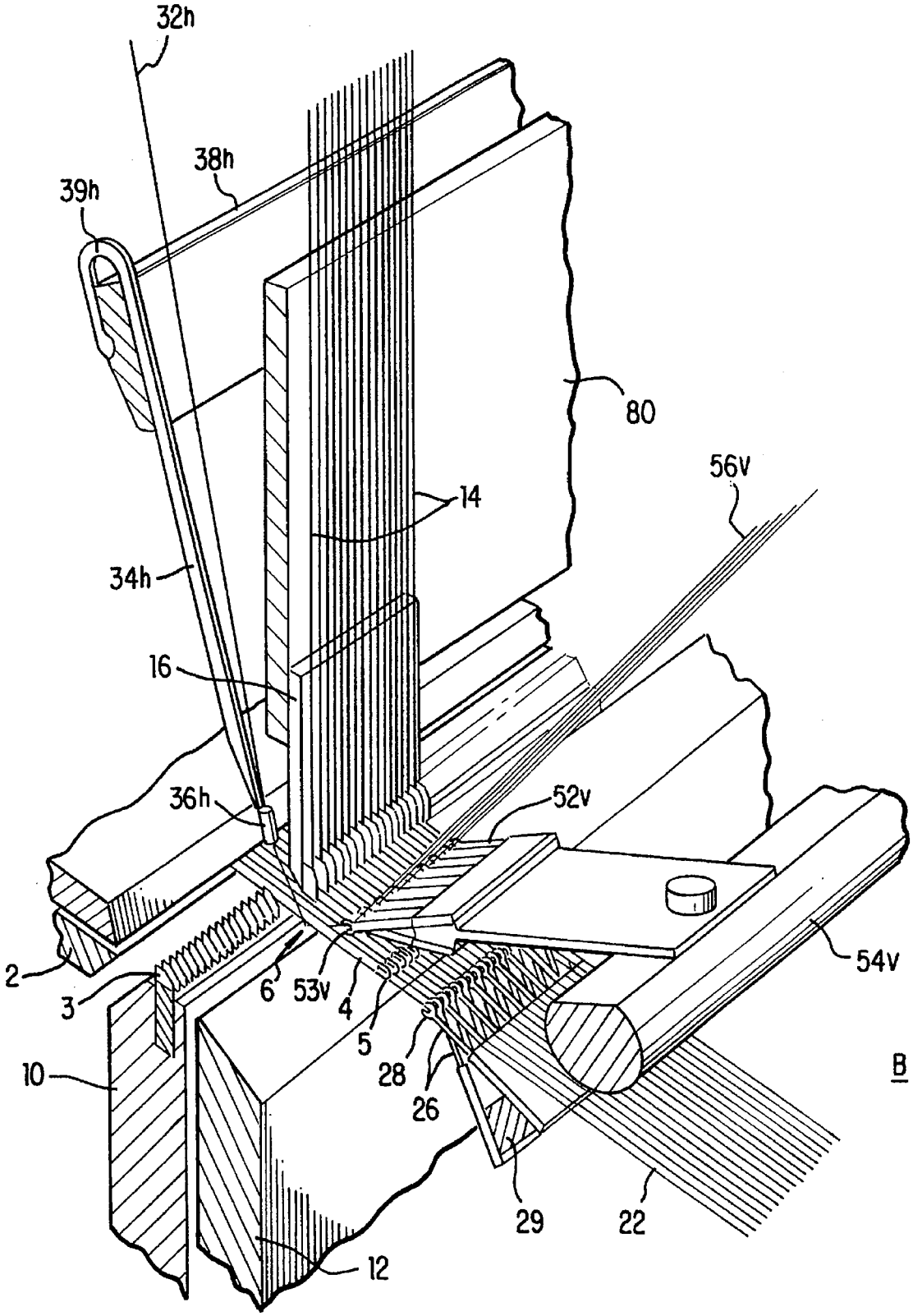
FIG. 5 is a perspective view taken from above, on the left, of some of the crocheting tools as shown in FIG. 1 with the crochet needles shifted forward.
Figure 6:
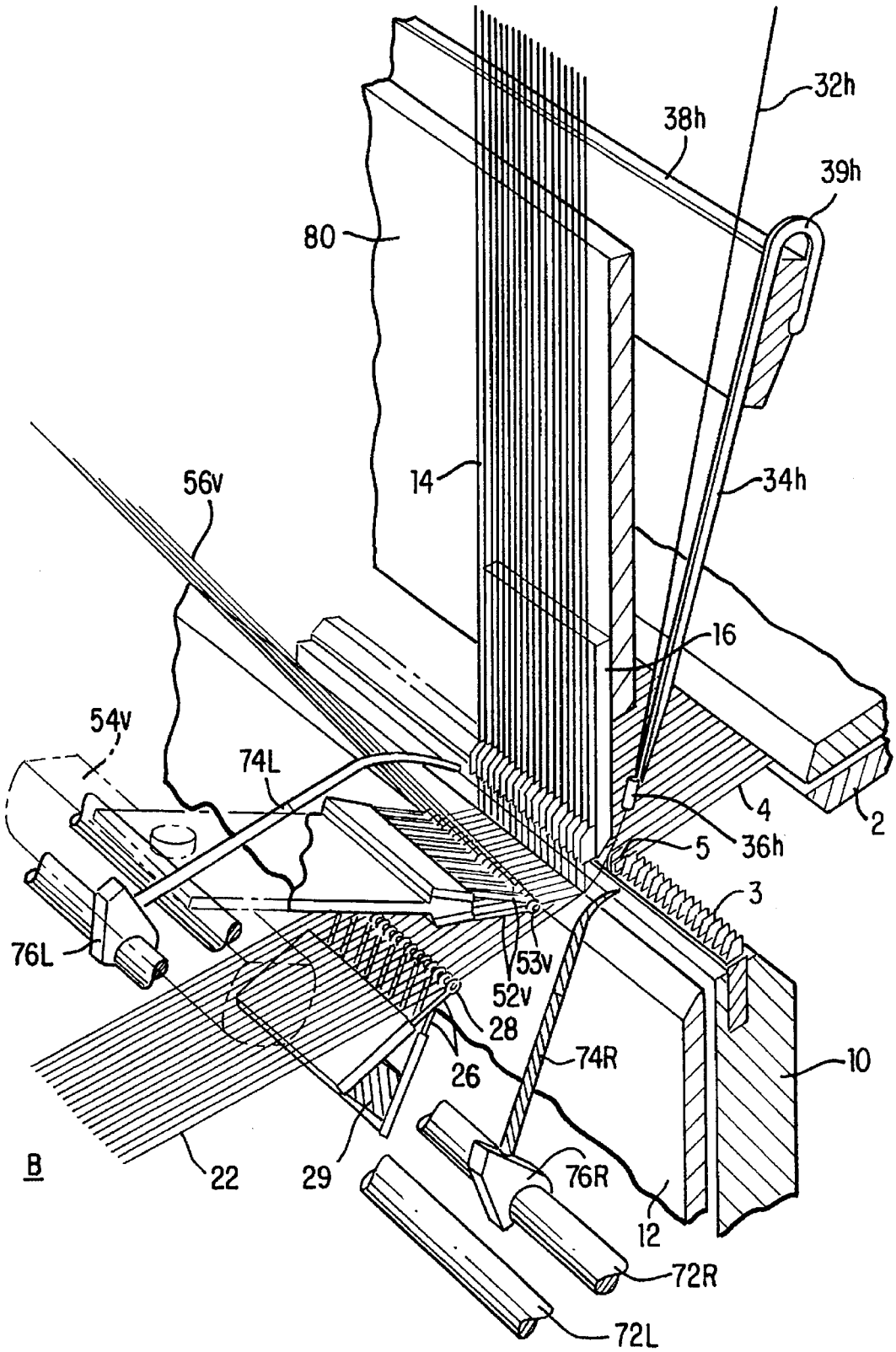
FIG. 6 is a perspective view taken from above, on the right, of some of the crocheting tools as shown in FIG. 1 with the crochet needles fully retracted.

The reference location B of the observer is on the right in FIGS. 1, 2 and 5, on the left, underneath in FIG. 6 and underneath in FIG. 3.

Arrays of rubber (natural or artificial rubber) threads 14 are guided from above greatly expanded (roughly 100%)

between the teeth of combs 16 to a mesh forming spot 6. The finish-crocheted band 8 is drawn off downwards with the same expansion, in a narrow gap between a knock-over bar 10 and a hold-back bar 12.

FIG. 1 illustrates, as viewed from the left, a needle bar 2 in which the crochet needles 4 (snap lock needles) are clamped by their heads 5. By means of the needle bar the crochet needles are moved forwards from their fully rear position between teeth 3 of a knock-over bar 10 and the rubber threads 14, as shown in FIGS. 1 and 2, to a forward position as shown in FIG. 5 and back again.

An array of warp threads 22 is guided by a warp beam 24 through the heads 28 of warp thread eye needles 26 to the mesh forming spot 6. Two sets of eye needles 26 are rigidly secured to each warp thread laying bar 29, so that their heads interengage as is described in EP-A-0 266 481-BERGER. The warp thread eye needles are moved forwards and backwards (as viewed from the point of observation B). In addition, the eye needles are shifted to and fro, i.e., right-left-right, by roughly the spacing between two crochet needles 4 so that the heads 5 of the crochet needles are wrapped by the warp threads.

For introducing a forward weft thread, termed "single weft" in this context, meaning either a single thread or a bundle of single threads in juxtaposition, a rear and a front single weft laying device **30*h* and 30*v* respectively is employed, located behind or in front of the web for each of the arrays of elastic threads 14. Each of these single weft laying devices has a weft thread guide 34*h*, 34*v* firmly clasping from above a laying bar 38*h*, 38*v* by a hook 39*h*, 39*v* and by which it is controlled. At its lower end this guide has a tube 36*h*, 36*v* through which the single weft thread 32*h*, 32*v* is guided to and fro, i.e. above the warp threads 22 and at right angles thereto in the vicinity of the mesh forming spot 6**. The tubes guide the weft threads on an upwardly curved path from the left-hand edge of the array of warp threads and rubber threads to their right-hand edge and back, so that it is included in crocheting.

To produce a fleece on the face of the band 8, an array of weft threads is supplied by a front weft array laying device **50*v*, i.e. through the heads 53*v* of the eye needles 52*v* attached to a weft array laying bar 54*v*. This is illustrated in more detail in FIG. 5. Preferably these eye needles 52*v* are arranged the same as eye needles 26, i.e. in the form of slanting packages of interengaging eye needles. The eye needles 52*v* are shown in two different layers in FIG. 1; in an upper layer in which the front weft threads 56*v* run slanting from above at the front to the mesh forming spot 6, and in a lower layer in which the heads of the weft thread eye needles 53*v* are guided through the array of weft threads 22. The weft threads are taken along by the warp threads in wrapping around the heads 5** of the crochet needles prior to being included in the mesh.

If the elastic band to be crocheted is required to have a fleece only on one side, e.g. on its facing broadside, then care must be taken to prevent it from later curling up due to the lack of symmetry of the weft threads. For this purpose, a bundle of parallel weft threads instead of a single weft thread is introduced by the rear single weft laying device **30*h* in this case (not to be confused with an array of weft threads as introduced by a weft array laying device such as 50*h***, for instance).

If the underside of the elastic band is also required to have a fleece, then—as shown in FIG. 2—instead of the rear single weft laying device **30*h*, a rear weft array laying device 50*h* may be arranged which guides an array of rear weft threads 56*h* to the mesh forming spot. FIG. 2 shows the situation in which the rear weft thread eye needles 52*h* are introduced as far as possible to the mesh forming spot 6**. In this situation too, they are included in meshing, their advanced right-left shift dictating between which crochet needles this occurs.

By employing front and rear weft array laying devices elastic bands can be crocheted with a fleece on both sides.

FIG. 3 shows—on a slightly different scale—the needle bar 2 from above and the crochet needles 4 clamped therein as well as the weft thread guides **34*h*, 34*v* together with the tubes 36*h*, 36*v* for the rear and front single weft threads respectively. The combs 16 for the rubber threads are secured to a laying bar 80**.

The front weft thread eye needles **52*v* are secured to the front weft thread laying bar 54*v* and the eye needles 26 for the warp threads are secured to the corresponding warp thread laying bar 29**.

For the sake of simplicity FIG. 3 shows only one set each of crocheting tools, however, many such sets will be arranged by known means alongside each other sideways over the width of the machine.

Figure 4:
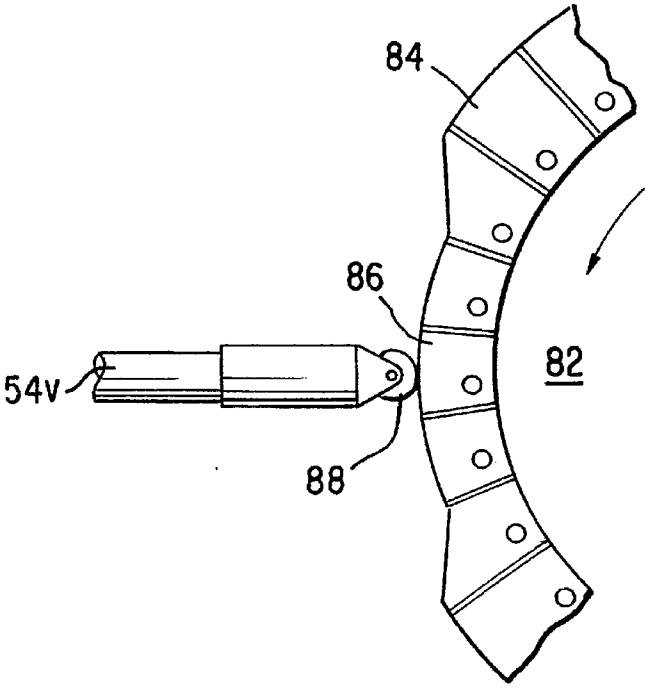
FIG. 4 is a front view of part of a chain link control.

FIG. 4 indicates a chain link drum 82 around which chains run for sideways control of each laying bar. Only one chain is shown, having chain links, 84 and 86 for controlling the front weft thread laying bar **54*v*. Depending on the height (as measured radially) of the chain links the laying bar 54*v* for the front weft thread eye needles 52*v* is moved sideways via a scanning roller 88. By means of this arrangement, the front weft threads are moved past one or more warp threads depending on the desired pattern of the fleece which, by known means, is achieved by employing correspondingly higher or lower chain links 84, 86**.

The same applies to the rear weft thread laying bar **54*h* (not shown in FIG. 4), the warp thread laying bar 29 and the rear and front laying bar 38*h*, 38*v* being controlled by other chains for the single weft threads. The warp thread laying bar 29 is displaced right-left-right, but only to a minor degree, i.e. essentially by the center-spacings between two neighboring crochet needle heads 5**.

FIG. 5 shows part of the crocheting tools with the crochet needles 4 disposed fully forward, it also showing one of the many sets of front warp thread eye needles 26 to be arranged in juxtaposition, but illustrating only one array of warp threads 22. The warp threads run from the heads 28 of the eye needles 18 to the mesh forming spot 6. The tube **36*h* is depicted in its outermost position on the left, it feeding the rear weft thread 32*h*. The hook 39*h* of the weft thread guide 34*h* is apparent, it clasping its (rear) laying bar 38*h*** with which it is moved right-left-right.

The front single weft laying device **30*v* and the rear weft array laying device 50*h* have been omitted from FIGS. 5 and 6** for a better understanding of the situation.

As evident from FIGS. 5 and 6, an array of front weft threads **56*v* is guided from above at the front to the heads of the front weft thread eye needles 52*v*. The sets of front weft thread eye needles 52*v* are secured to the laying bar 54*v* which (on the rear right in FIG. 5**) runs to the chain link drum.

Function of the Crochet Tools described this far

One array each of rubber threads 14 is guided from above between the teeth of one of the combs 16 to the mesh forming spot 6. The crochet needles 4 are moved forwards and backwards by the needle bar 2 between the teeth 3 of the knock-over bar 10 and engage the rubber threads. The warp thread eye needles 26 feed the warp threads 22 from the front and ensure by a sideways displacement that the heads 5 of the crochet needles are wrapped. The rear weft thread guide 34*h* lays a rear weft thread from the right to the left and back crosswise over the array of rubber threads 14. The front weft thread eye needles 52*v* engage between the array of warp threads 22 slantingly from above downwards from the front, so that the front weft threads 56*v* are guided slantingly downwards from the front to the mesh forming spot 6 and layed together with the warp threads in the heads of the crochet needles. Meshing is done by means which are known as such, and the finished elastic band 8 is drawn off downwards, its elastic threads being sufficiently stretched as allowed by the warp threads 22. Later, when the elastic band is released, it contracts longitudinally, the desired fleece then resulting by the front weft threads 52*v* once smooth, now forming loops.

The structure of the fleece can be varied, for one thing by the number of weft threads 56*v* employed. In general, not every weft thread eye needle 52*v* supplies a weft thread. Instead other eye needles between those feeding weft thread may be left empty, depending on the pattern desired. Furthermore, the extent of the sideways movement of the laying bars and of the weft thread eye needles can be controlled the height and circumferential length of the chain links employed.

If, in addition, a rear weft array laying device 50*h* is provided, an elastic band can be crocheted which is faced and backed with a fleece, the pattern of which may be the same or different on the two sides.

If no fleece is required on either side of the band, then instead of the front and rear weft array laying devices 50*v*, 50*h*, front and rear single weft laying devices 30*v* and 30*h* are employed.

Picot Device and its Function

If the elastic band is required to have picots (looplets) on one or both edges, then in addition, a right-hand and a left-hand picot device 70R and 70L respectively is used, as illustrated only in FIGS. 1 and 6. Each of the two picot devices has a so-called clawer 74R and 74L respectively, namely a talon which as shown in FIG. 1 is pointed at its upper end and curved to the left. Each clawer is firmly mounted in a holder 76R, 76L respectively, by means of which it is located non-rotatable on a drive shaft. The two drive shafts are also driven by a chain of the chain link drum, an initially produced right-left movement being converted by mechanical deflection into pure pivoting movements of the drive shafts 72R and 72L by means known as such.

If picots are required only on one edge of the band, only one of the clawers is set in motion, while the other is removed remains pivoted OFF, the same as clawer 74L as shown in FIG. 1. If the front weft thread 32*v* executed fully to the right, then to produce a picot, the clawer 74R is pivoted into its effective position as shown in FIG. 1. The front weft thread 32*v* is moved to the left, as usual, by the front weft thread guide 34*v* over the width of the warp thread band, such as shown by reference numeral 96 in FIG. 7 and is crocheted in place. The right-hand clawer is then pivoted OFF, a picot then remains on the right-hand edge of the band.

Correspondingly the same applies to the left-hand edge of the band, where picots maybe produced by the clawer 74L.

It is possible to produce picots on only the left-hand edge, only on the right-hand edge, or on both edges. The picots may be produced regularly or irregularly far or closely spaced, depending on the control of the drive shafts 72R and 72L.

Figure 7:
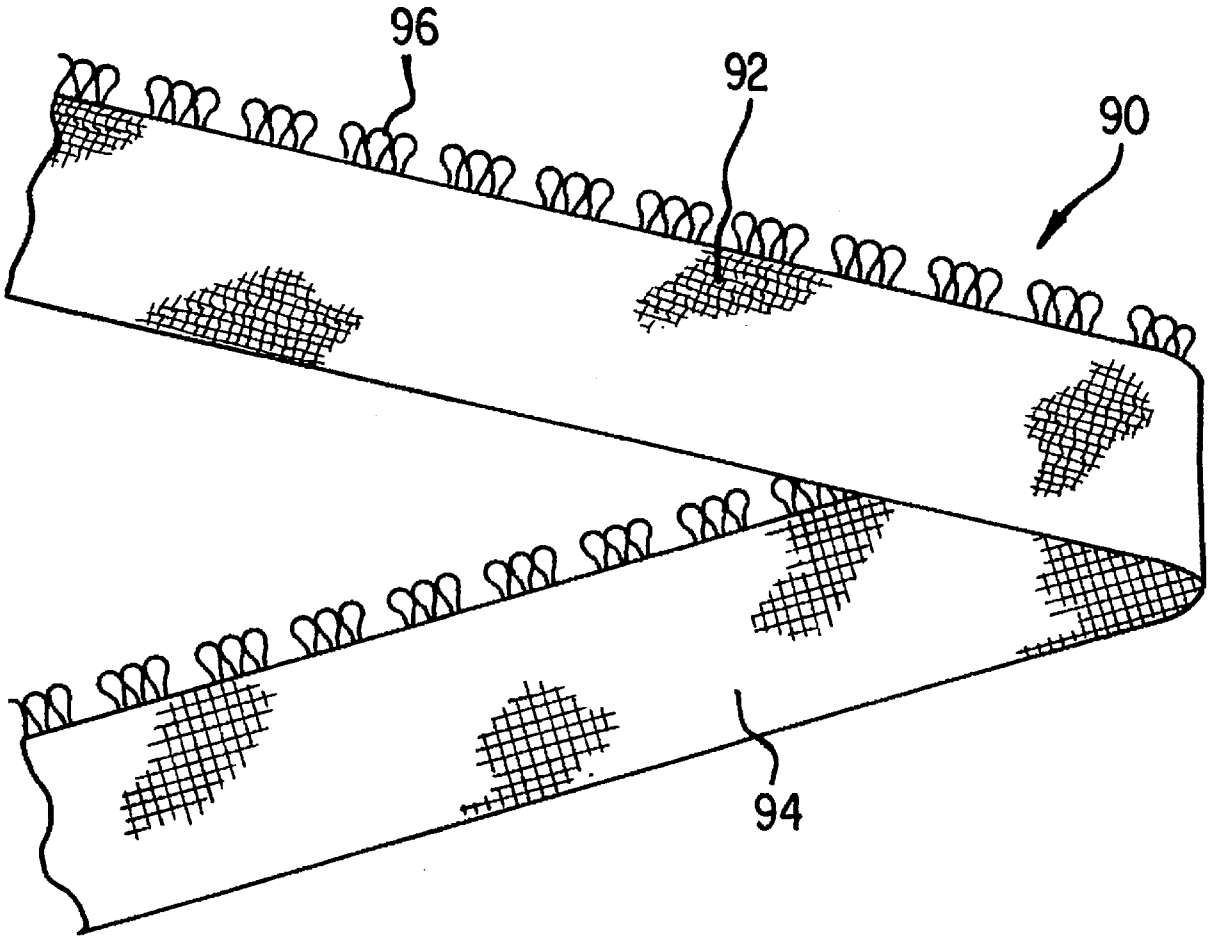

FIG. 7 shows a piece of elastic band 90 produced according to the method as previously described. Band 90 includes picots (looplets) only on one side thereof, here the upper portion 92. The lower portion 94 shows the other side of the band, in this embodiment without picots (looplets).

REFERENCE NUMERALS

B point of observation
2 needle bar
3 tooth
4 crochet needle
5 crochet needle head
6 mesh forming spot
8 elastic band
10 knock-over bar
12 hold-back bar
14 rubber threads
16 comb

20 laying device for warp thread assy
22 warp threads
24 warp beam
26 warp thread eye needle
28 head of warp thread eye needle
29 warp thread laying bar

30*h*, 30*v* rear, front single weft laying device
32*h*, 32*v* rear, front weft thread
34*h*, 34*v* rear, front weft thread guide
36*h*, 36*v* rear, front tube
38*h*, 38*v* rear, front laying bar for single weft
39*h*, 39*v* rear, front hook
50*h*, 50*v* rear, front weft array laying device
52*h*, 52*v* rear, front eye needles for weft array
53*h*, 53*v* rear, front heads of eye needles
54*h*, 54*v* rear, front weft array laying bar
56*h*, 56*v* rear, front weft threads
70L, 80R picot device
72L, 72R drive shaft for left/right-hand clawer
74L, 74R left/right-hand clawer
76L, 76R left/right-hand holder

80 laying device for rubber threads
82 chain link drum
84, 86 chain link
88 scanning roller

We claim:

1. A device on a warp knitting machine for crocheting a particularly fine elastic band having at least one broadside with fleece thereon, the warp knitting machine having a width and a mesh forming spot, said device comprising:

a plurality of crochet needles, said plurality of crochet needles includes more than eight crocheting needles at a density of at least eight needles per centimeter of machine width and being disposed proximate said mesh forming spot;

a needle bar reciprocally movable forward and backward, said plurality of crochet needles being fixedly attached to said needle bar and movable with said needle bar;

a warp thread laying device, said warp thread laying device feeding an array of warp threads proximate to the mesh forming spot, said warp-thread laying device including a warp thread laying bar and first and second sets of warp thread eye needles physically coupled to the warp thread laying bar, said first and second sets of eye needles having heads and being fixedly arranged at an acute angle to each other so that the heads of the eye needles of the first set interengage with the heads of the eye needles of the second set, said warp thread laying bar being reciprocally movable forward and backward and capable of side shifting;

at least one single weft laying device located proximate to the mesh forming spot, said single weft laying device feeding at least one weft thread;

an elastic thread laying device located proximate to the mesh forming spot, said rubber thread laying device feeding an array of stretched rubber threads; and at least one weft array laying device located proximate to the mesh forming spot, said weft array laying device including sets of weft thread eye needles feeding an array of weft threads.

2. The device as set forth in claim 1, wherein said plurality of crocheting needles includes at least twelve crocheting needles at a density of at least twelve crocheting needles per centimeter of machine width.

3. The device as set forth in claim 1, wherein said at least one single weft laying device includes a single weft laying device for feeding at least one weft thread.

4. The device as set forth in claim 1, wherein said at least one weft array laying device includes a front weft array laying device and a rear weft array laying device, each weft array laying device having a longitudinal axis and a weft thread laying bar, said weft laying bar being longitudinally reciprocally with respect to the mesh forming spot and pivotable about its longitudinal axis.

5. The device as set forth in claim 4, wherein said weft thread eye needles of said front weft array laying device include heads which are guided for movement in a forward and downward direction, and engage between the array of warp threads for layering the array of weft threads with the array of warp threads.

6. The device as set forth in claim 4 wherein said weft thread eye needles of said rear weft array laying device includes heads which are advanced to the vicinity of the mesh forming spot from the rear and above in response to retraction of said crocheting needles.

7. An elastic band having a fineness corresponding to more than eight rubber threads per centimeter and a fleece of an array of weft threads on a broadside thereof formed by the steps of:

providing proximate a mesh forming spot: a plurality of crocheting needles, a needle bar, a warp thread laying device for feeding an array of warp threads, at least one single weft laying device for feeding at least one weft thread, an elastic thread laying device for feeding an array of tightly stretched elastic threads, and at least one weft array laying device for feeding an array of weft threads; and knitting together the array of warp threads, the array of weft threads, the array of elastic threads, and said at least one weft thread.

8. The rubber band formed by the process of claim 7 wherein said elastic band further comprises loops on at least one edge thereof.

* * * * *